United States Patent [19]

Bergstrom et al.

[11] 4,431,107

[45] Feb. 14, 1984

[54] MODULAR RACK ARRAY

[75] Inventors: Ronald F. Bergstrom, Lodi; Philip G. Bartko, Ione, both of Calif.

[73] Assignee: Agri-Fab Industries, Incorporated, Lodi, Calif.

[21] Appl. No.: 337,323

[22] Filed: Jan. 6, 1982

[51] Int. Cl.[3] ..... A47F 5/01

[52] U.S. Cl. ..... 211/49 S; 211/189; 211/194

[58] Field of Search ..... 211/49 S, 13, 189, 182, 211/60 R, 194; 108/55.3; 410/49; 206/391, 600, 386, 319

[56] References Cited

U.S. PATENT DOCUMENTS

| | | | |
|---|---|---|---|
| 2,588,278 | 3/1952 | Noerr | 206/391 |
| 2,766,660 | 10/1956 | Laddon et al. | 211/13 X |
| 3,019,916 | 2/1962 | Malcher | 108/55.3 X |
| 4,210,202 | 7/1980 | Boyer et al. | 211/49 S X |

FOREIGN PATENT DOCUMENTS

| | | | |
|---|---|---|---|
| 1132355 | 11/1956 | France | 211/49 S |
| 1268752 | 3/1972 | United Kingdom | 410/49 |
| 1409559 | 10/1975 | United Kingdom | 108/55.3 |

*Primary Examiner*—Ramon S. Britts
*Assistant Examiner*—Robert W. Gibson, Jr.
*Attorney, Agent, or Firm*—Lothrop & West

[57] ABSTRACT

A modular rack array for supporting in stacked vertical relation, successive rows of horizontally disposed barrels. An elongated base rack for supporting a base row of barrels is assembled from a plurality of modular base rack sections. Each modular base section is formed from members having hill and valley portions, and the valley portion of each section supports a barrel oriented with its bung facing upwardly. One or more stacking racks, each including a series of similar modular rack sections, is successively assembled, stacked, and loaded with barrels, the entire assemblage resting upon the underlying, established row of barrels. Modular end braces, connected to the end extremities of each rack, add further rigidity to the rack and barrel array.

5 Claims, 6 Drawing Figures

MODULAR RACK ARRAY

BACKGROUND OF THE INVENTION

The invention relates generally to structures for supporting cylindrical containers in horizontal rows, stacked in vertical relation. More specifically, a modular rack configuration for storing wine barrels, or the like, is disclosed.

Wine must be stored at a substantially constant temperature for extended periods of time for its taste and bouquet to mature fully. Through well known and commonly accepted practice, the wine is aged in wooden barrels housed within a temperature-stable building or cavern. From time to time during the aging period, the wooden barrels are washed to remove surface contaminants and the level of the contained wine is checked and replenished if necessary. Additionally, the aging wine is tested periodically for proper chemical composition and development. These maintenance and testing procedures necessitate repeated physical access to the bung, or stopper of each barrel.

Consequently, the storage racks for wine barrels have developed into specialized pallets, designed to be vertically stacked by means of a forklift to form a self supporting array. Representative of these specialized pallets for cradle supporting two or three barrels are the structures disclosed in Jay, U.S. Pat. No. 3,476,260, Malcher, U.S. Pat. No. 3,019,916, and in Ljungdahl, U.S. Pat. No. 3,146,733. These designs demand that for each barrel maintenance and wine testing operation performed throughout the aging period, individual pallets be successively removed from the existing array of pallets and then lowered to the ground. The barrel bungs and outer walls are then accessible for whatever washing, filling, and testing may be necessary. After completion, the pallets are again stacked to restore the array.

Certainly one drawback to the specialized pallet approach stems from the repetitious, but necessary, physical manipulation of the heavily laden pallets. The pallet unstacking and stacking jobs have proved both labor consuming and potentially dangerous for the forklift operator. These considerations aside, the array of vertically stacked pallets is not particularly stable itself. Since adjacent vertical rows of pallets are not structurally integrated, even a moderate earthquake can set the assemblage into motion and possibly effect its collapse. There are, in other words, certain disadvantages associated with the use of such pallets for stacking and storing wine barrels.

SUMMARY OF THE INVENTION

The present invention provides a modular rack construction for stacking barrels on their sides to form a vertically extending, integrated array. The rack and barrel array includes a base rack and a plurality of vertically spaced stacking racks. The racks are tubular in construction and undulating in form, having alternating hill and valley portions adapted to accommodate the curvature of the barrel walls.

Both the base rack and the stacking racks are formed by coupling a plurality of modular, undulating cradle rack sections. The base rack sections are quite similar to the stacking rack sections, but include additionally a support footing to allow the base rack to lie directly upon the floor.

Once the base rack has been assembled, barrels are laid on their sides and positioned within each undulating valley, or cradle portion of the base rack. In this manner, the barrels in the base row are supported in horizontal relation, with their axes parallel and their adjacent walls spaced a predetermined distance. Having established the base row of barrels, alternating stacking tracks and respective stacking rows of barrels are successively assembled upon one another until the array is completed.

Modular end braces are coupled to opposing ends of the base and stacking racks to add further rigidity to the array. The valley portions of the racks support superjacent barrels and the hill portions overlie subjacent barrels. With the barrels, rack, and vertical end braces so structurally integrated, the array is much less suceptible than the previously mentioned stacked pallet approach to collapsing under the stresses produced by an earthquake.

Since the barrels in vertically adjacent rows are stacked in horizontally offset relation, an access space is provided immediately over the upfacing side of each barrel. Workers are therefore readily able to pull each barrel bung and perform the necessary testing and maintenance operations without removing a single barrel from the array. Also, almost all of the outer surface of each barrel is exposed within the array and accessible, making barrel washing a relatively easy matter. The modular construction of the racks and the end braces allows the array to be expanded or contracted through a horizontal or vertical aspect as desired. The vertical end braces allow the array to assume a square or rectangular configuration. By eliminating the end braces, a simple triangular array of racks and barrels can be assembled.

Other refinements and variations upon the basic modular design outlined above will become more apparent from the detailed description and accompanying drawings to follow.

DETAILED DESCRIPTION OF PREFERRED EMBODIMENT

Figure 2:
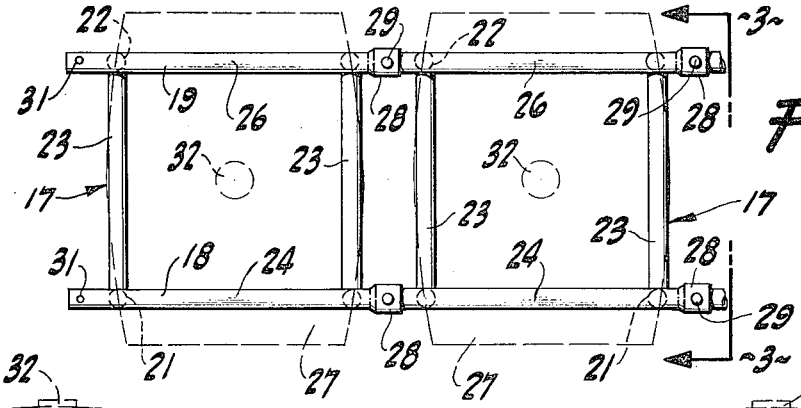
FIG. 2 is a top plan view of two modular base sections, two barrels being shown in broken line.
Figure 3:
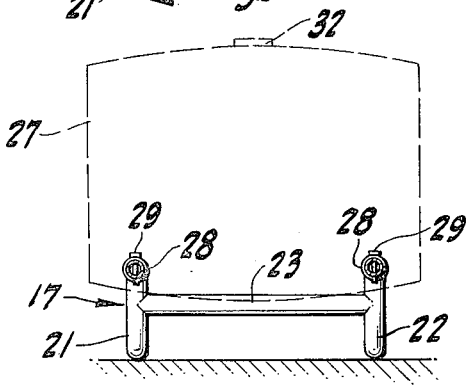
FIG. 3 is a side elevational view taken on the line 3—3 in FIG. 2, showing the front and rear support leg assemblies, a single barrel being shown in broken line.

The stacker 11, or array includes an undulating base rack 12, a plurality of undulating stacking racks 13, and at least one vertical end brace 14. The base rack 12 lies directly upon the floor 16, and includes an assemblage of modular base sections 17. Making reference to FIGS. 1, 2, and 3, each base section 17 includes a front tube 18, a support frame, and a rear tube 19, or support frame. W-shaped tubular support footings 21 and 22 are attached to the respective undersides of the front tube 18 and the rear tube 19, as is shown most clearly in FIGS. 1 and 3. Each base section 17 also has a pair of transverse spacer tubes 23 attached to the upper portions of the support footing 21 and the support footing 22. The front tube 18 and the rear tube 19 are thereby maintained in a parallel orientation and spaced a predetermined distance from each other.

V-shaped depressions 24 and 26 in the median portions of the front tube 18 and the rear tube 19, respectively, form a cradle for supporting a barrel 27. The length of the spacer tubes 23 is such that the end portions of each barrel 27 extend somewhat beyond the front and rear of each modular base section 17 (see FIG. 3). And, the depth and configuration of the depressions 24 and 26 are such that the curved outer wall of each barrel 27 will nest securely therein as the array is assembled.

At one side of each modular base section 17, the end portions of the tubes 18 and 19 are provided with a coupler 28. The coupler 28 includes a flared inner diameter, capable of accommodating the outer diameter of the respective end portions of the tubes 18 and 19 of an adjacent base section 17. A pin 29 passes through the coupler 28, registering within an aperture 31 in each end of the tubes 18 and 19, (see FIGS. 2 and 3). Although this simple coupling system has proved very satisfactory, any number of coupling adapters could be used to interconnect the modular base sections with similar results.

The modular base sections 17 are successively coupled to form an undulating base rack 12 of the desired length. The length of the base rack 12 determines the ultimate width of the array 11, as viewed in FIG. 1. However, in a manner to be set forth in greater detail herein, both the size and the shape of the array 11 can be modified from time to time as the need arises and with relative ease.

Figure 1:
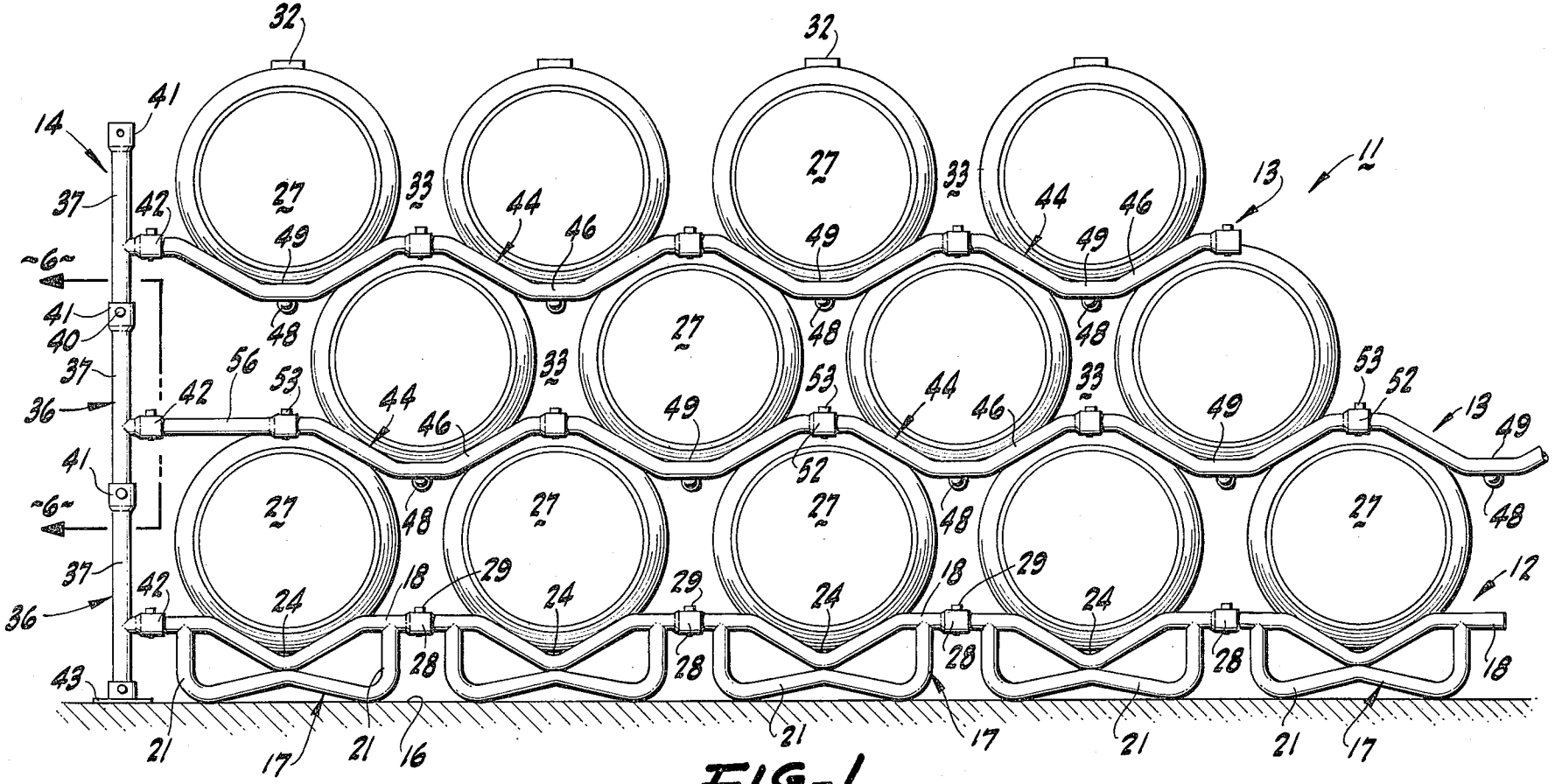
FIG. 1 is a front elevational view of a partially assembled array, showing an undulating base rack and two undulating stacking racks interlocked by a vertical end brace.

Toward further assembly of the array 11, a barrel 27 is placed upon each modular base section 17, overlying and resting within the V-shaped depressions 24 and 25. The bung 32, or stopper within the side wall of each barrel 27 is oriented to face upwardly to ensure easy access when the array is fully completed. Owing to the orientation and spacing of the barrels 27 within this base row, successive stacking rows of barrels 27 are supported in alternating offset relation, as is best shown in FIG. 1. The offset stacking of vertically adjacent rows of barrels provides an access space 33 immediately above the bung 32 of each barrel 27. Such accessibility to each bung allows testing and maintenance of the contained wine to be performed without moving any barrels or otherwise disturbing the array.

Figure 6:
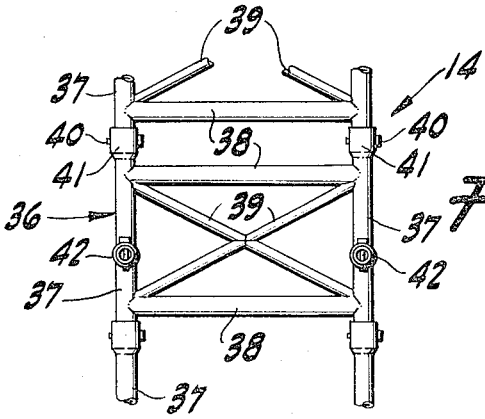

The modular construction of the base rack 12 is applied to the end brace assembly 14 as well. Successive modular end brace sections 36 are coupled end to end forming an assembly 14 of the selected height (see FIG. 1). Making particular reference to FIG. 6, each end brace section 36 includes a pair of vertical posts 37 spanned by a pair of horizontal bars 38 and by a pair of cross braces 39. The upper end of each post 37 includes a coupler 41 for receiving the lowermost portion of the post 37 of the superjacent brace section. A bolt 40 secures the post 37 within the coupler 41, much in the same manner as the pin 29 interconnects adjacent base sections 17.

Extending horizontally from each post 37 is a coupler 42 for interlocking each brace section 36 with the adjacent rack. For example, the couplers 42 of the lowermost end brace section 36 are pin locked to the front tube 18 and the rear tube 19 of the adjacent base section 17, as shown in FIG 1. A floor flange 43 secures the lower end of the end brace assembly 14 to the floor, adding further rigidity to the array 11. It should be noted that only a single end brace assembly 14 is shown in FIG. 1, for illustrative purposes. However, a typical rectangular or square array would include two brace assemblies, one on either end of the array.

Figure 5:
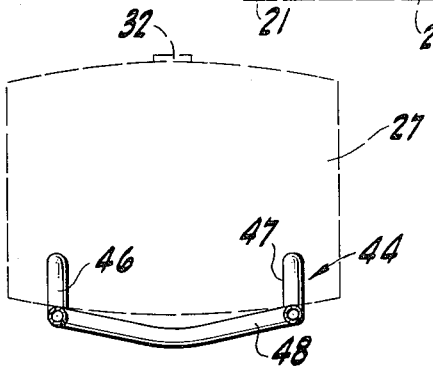
FIG. 5 is a transverse, cross-sectional view taken on the line 5—5 in FIG. 4; and, FIG. 6 is a side elevational view of the modular end brace assembly taken on the line 6—6 in FIG. 1.

The first stacking rack 13 is now assembled from a plurality of modular stacking sections 44. Making specific reference to FIGS. 1, 4, and 5, each stacking section 44 includes a front tube 46, or support structure, and a rear tube 47, or support structure, spanned by a transverse spacer tube 48. The tubes 46 and 47 are generally parallel to each other and include respective valley portions 49 and 51, shaped to conform to the curvature of the barrels 26. The spacer tube 48 is further bowed downwardly in its median portion to ensure that each barrel will rest solely within the valley portions 49 and 51 when the stacking rows are formed (see FIG. 5).

The size, spacing, and parallel orientation of the tubes 44 and 46, closely follow the same physical parameters of the tubes 18 and 19. The resulting structural conformities between the base rack 12 and the stacking racks 13 ensure that adjacent rows of barrels will be horizontally offset to a uniform extent. The axes of the barrels in every other row, then, are in perfect vertical alignment (see FIG. 1).

Figure 4:
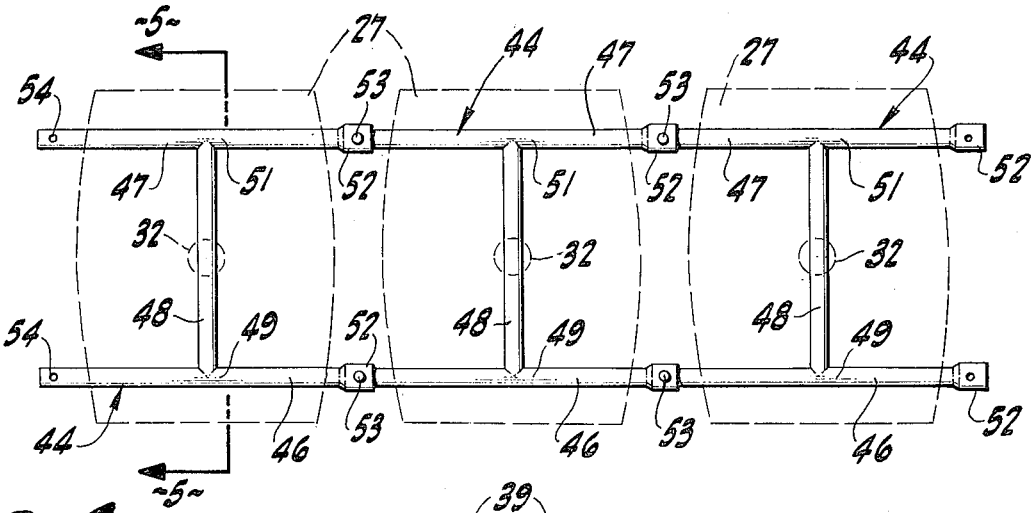
FIG. 4 is a top plan view of two modular stacking sections, three barrels being shown in broken line.

Apertured couplers 52 are provided at one end of each tube 46 and 47, as shown most clearly in FIG. 4. To joint adjacent stacking sections 44, pins 53 are passed through apertures in the couplers 52 and through registering apertures 54 in the other end of the adjacent tubes 46 and 47. Once the stacking rack 13 is fully assembled and overlying the barrels of the subjacent base row, a pair of linear extension tubes 56 couples the stacking row's end extremity with the end brace assembly 14 (see FIGS. 1 and 6). A barrel 27 is then laid across the valley portions 49 and 51 to complete the stacking row.

It is apparent that additional stacking racks and stacking rows of barrels can be assembled in like manner, stacked in vertical relation upon the subjacent barrels, as illustrated in FIG. 1. With the modular construction of the base sections, stacking sections, and end brace sections, the array can be expanded or contracted merely by adding or removing barrels and the appropriate modular sections. Thus, despite the fact that the barrels and the racks are structurally integrated, the modular construction of the rack and brace sections permits the size and shape of the array to be modified with minimal structural disruption.

Variations upon the specific construction of the modular rack and brace sections are many. The modular sections could be constructed from square, rather than round tubing. Solid rod could be substituted for the tubular construction used herein, although excessive weight may prove this alternative construction less desirable.

Rather than using the simple pin and aperture locking mechanism shown herein, a latching or detent coupler, for example, could readily be adapted to interconnect modular sections of the array.

As another alternative, the undulating base rack could be formed from modular, molded, plastic sections of walled construction, having appropriately oriented and spaced arcuate cutouts or recesses to cradle the lower portion of each barrel in the base row. Both the base and stacking racks, in addition, could be fashioned from front and rear frames of varying design, including hill portions and valley portions assuming specific configurations somewhat different than those disclosed, but nonetheless performing the same function of cradle supporting the barrels.

Similarly, the length of the modular base and stacking sections, and the size and shape of the undulations contained therein, can be modified to result in an access space of different size and shape than that disclosed above.

However, none of these variations or modifications diverges from the spirit of the modular barrel rack array of the present invention.

We have presented, therefore, a simplified and improved approach to safely storing barrels for extended periods of time while retaining the flexibility that in situ barrel access provides.

We claim:

1. A modular rack array for supporting rows of barrels in stacked vertical relation, comprising:

a. a plurality of barrel supporting modular base sections, each of said base sections including: first and second undulating tubes, each of said tubes having a hill portion and a valley portion, said first tube and said second tube being arranged in parallel relation to cradle a respective barrel spanning said valley portions of said first tube and said second tube; a support footing mounted on said first and said second tubes, the bottom of said support footing being adapted to rest upon a horizontal surface, the height of said support footing being of sufficient vertical extent to elevate said valleys of said first and said second tubes above the horizontal supporting surface; and, base rack coupling means for interconnecting said first and said second undulating tubes with respective ones of an adjacent said modular base section to establish a longitudinal base rack and an associated base row of barrels;

b. a plurality of barrel supporting modular stacking sections, each of said stacking sections including: third and fourth undulating tubes, each of said tubes having a hill portion and a valley portion, said third tube and said fourth tube being arranged in parallel relation to cradle a respective barrel spanning said valley portions of said third tube and said fourth tube; and stacking rack coupling means for interconnecting said third and said fourth undulating tubes with respective ones of an adjacent said modular stacking section to establish a first longitudinal stacking rack and an associated first stacking row of barrels overlying and generally coextensive with said base rack and said base row, said third tube and said fourth tube being arranged in parallel relation above said first tube and said second tube, respectively, and said third and said fourth tubes being horizontally offset from said first and said second tubes so that said hill portions of said third and said fourth tubes overlie the subjacent barrel.

2. A modular rack array as in claim 7 in which said barrels can be positioned so that when the bungs face upwardly the vertical clearance above the bungs extends to the overlying one of said barrels.

3. A modular rack array as in claim 1 including a plurality of spacer tubes mounted on and extending between said first and said second tubes, and between said third and said fourth tubes.

4. A modular rack array as in claim 3 including a second longitudinal stacking rack and a second stacking row of barrels overlying and generally coextensive with said first stacking rack and said first stacking row, the third and fourth undulating tubes of said second stacking rack being horizontally offset from the underlying said third and fourth tubes of said first stacking rack so that said third and fourth tubes of said second stacking rack overlie the subjacent barrel.

5. A modular rack array comprising:

a. a plurality of first undulating tubes, each of said first undulating tubes including a hill portion and a valley portion;

b. a plurality of second undulating tubes, each of said second undulating tubes including a hill portion and a valley portion, said plurality of said first tubes and said plurality of said second tubes being arranged in parallel relation and extending longitudinally to cradle a plurality of barrels respectively spanning said valley portions of said first tubes and said second tubes;

c. a plurality of third undulating tubes, each of said third undulating tubes including a hill portion and a valley portion;

d. a plurality of fourth undulating tubes, each of said fourth undulating tubes including a hill portion and a valley portion, said plurality of said third tubes and said plurality of said fourth tubes being arranged in parallel relation and being located above and generally coextensive with said plurality of said first tubes and said plurality of said second tubes, respectively, said plurality of said third tubes and said plurality of said fourth tubes further being displaced from said plurality of said first tubes and said plurality of said second tubes so that said hill portions of said third and said fourth tubes overlie respective subjacent barrels and said valley portions of said third and said fourth tubes are spanned by and support a plurality of barrels;

e. at least one vertical end brace assembly rigidly connected to a respective end of said plurality of said first tubes and said plurality of said second tubes and to a respective end of said plurality of said third tubes and said plurality of said fourth tubes.

* * * * *

UNITED STATES PATENT AND TRADEMARK OFFICE

CERTIFICATE OF CORRECTION

PATENT NO. : 4,431,107

DATED : February 14, 1984

INVENTOR(S) : Ronald F. Bergstrom, Philip G. Bartko

It is certified that error appears in the above-identified patent and that said Letters Patent are hereby corrected as shown below:

Column 6, line 4, "claim 7" should read --claim 1--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*